United States Patent [19]

Hasegawa

[11] Patent Number: 4,823,113

[45] Date of Patent: Apr. 18, 1989

[54] GLASSY ALLOY IDENTIFICATION MARKER

[75] Inventor: Ryusuke Hasegawa, Morristown, N.J.

[73] Assignee: Allied-Signal Inc., Morris Township, Morris County, N.J.

[21] Appl. No.: 170,602

[22] Filed: Mar. 14, 1988

Related U.S. Application Data

[63] Continuation of Ser. No. 833,625, Feb. 27, 1986, abandoned.

[51] Int. Cl.[4] ..... G08B 13/18

[52] U.S. Cl. ..... 340/551; 148/403; 340/572

[58] Field of Search ..... 340/572, 551; 148/403, 148/304

[56] References Cited

U.S. PATENT DOCUMENTS

| | | | |
|---|---|---|---|
| 3,856,513 | 12/1974 | Chen et al. | 148/403 |
| 4,188,211 | 2/1980 | Yamaguchi et al. | 148/304 |
| 4,222,517 | 9/1980 | Richardson | 340/572 |
| 4,225,339 | 9/1980 | Inomata et al. | 148/403 |
| 4,236,946 | 12/1980 | Aboaf et al. | 148/403 |
| 4,288,260 | 9/1981 | Senno et al. | 148/121 |
| 4,298,862 | 11/1981 | Gregor et al. | 340/572 |
| 4,553,136 | 11/1985 | Anderson, III et al. | 340/572 |
| 4,647,917 | 3/1987 | Anderson, III et al. | 340/572 |
| 4,660,025 | 4/1987 | Humphrey | 340/572 |
| 4,663,612 | 5/1987 | Meijia et al. | 340/572 |

FOREIGN PATENT DOCUMENTS

| | | | |
|---|---|---|---|
| 763681 | 2/1934 | France | 340/551 |

OTHER PUBLICATIONS

"Observation of Magnetic Hysteresis Loop of the Perminvar Type in Worked Co-Based Amorphous Alloys", Appl. Phys., 2/15/80.

*Primary Examiner*—Glen R. Swann, III

*Attorney, Agent, or Firm*—Gus T. Hampilos

[57] ABSTRACT

A magnetic identification system marker is adapted to generate magnetic fields at frequencies that (1) are harmonically related to an incident magnetic field applied within an interrogation zone and (2) have both even and odd harmonics of the incident field frequency that provide the marker with signal identity, and coding capability. The marker is an elongated, ductile strip of amorphous ferromagnetic material.

10 Claims, 7 Drawing Sheets

GLASSY ALLOY IDENTIFICATION MARKER

This application is a continuation of application Ser. No. 833,625 filed Feb. 27, 1986, now abandoned.

DESCRIPTION

Field of Invention

This invention relates to identification systems and markers for use therein. More particularly, the invention provides a ductile, glassy metal marker that can be categorically identified.

Description of Prior Art

Identification of people or commercial goods and the like passing through a gate is an important matter to personal and commercial security. Similarly important is an effective sorting of materials in an automated production line. All of these become possible if the marker of the carrier, be it a person or an article, can be discriminately identified. Mere detection of the marker is not sufficient.

Prior art relating to the above problem includes use of soft magnetic materials as detection markers. One such example is given by a U.S. Pat. No. 4,298,862 issued to Gregor et al., which teaches use of an amorphous metal marker in an antipilferage system. Although harmonic signals are used in the detecting system, the Gregor et al. patent does not teach means for distinguishing one marker from another. Rather in Gregor et al. there is disclosed merely a method for detecting the existence of the marker.

Clearly desirable is a marker can be unequivocally identified, such a marker is provided by the present invention.

SUMMARY OF INVENTION

Briefly stated, the invention provides a glassy ferromagnetic metal marker capable of generating identifying signal characteristics in the presence of an applied magnetic field. The marker is sufficiently ductile that flexing or bending does not affect its identifying signal characteristics.

In addition, the invention provides a decoding system for identifying the marker within a definable interrogation zone. Means are provided for generating a magnetic field within the interrogation zone, which serves as the exciting field. A glassy metal marker is secured to a person or an article appointed for passage through the interrogation zone. The marker contains a glassy ferromagnet in the form of an elongated strip or wire which is capable of generating magnetic fields at frequencies which are both even and odd harmonics of the frequency of the exciting field. A decoding means is provided to identify the glassy metal marker.

BRIEF DESCRIPTION OF THE DRAWINGS

The invention will be more fully understood and further advantages will become apparent when reference is made to the following detailed description of the preferred embodiment of the invention and the accompanying drawings in which.

DETAILED DESCRIPTION OF THE INVENTION

Figure 1:
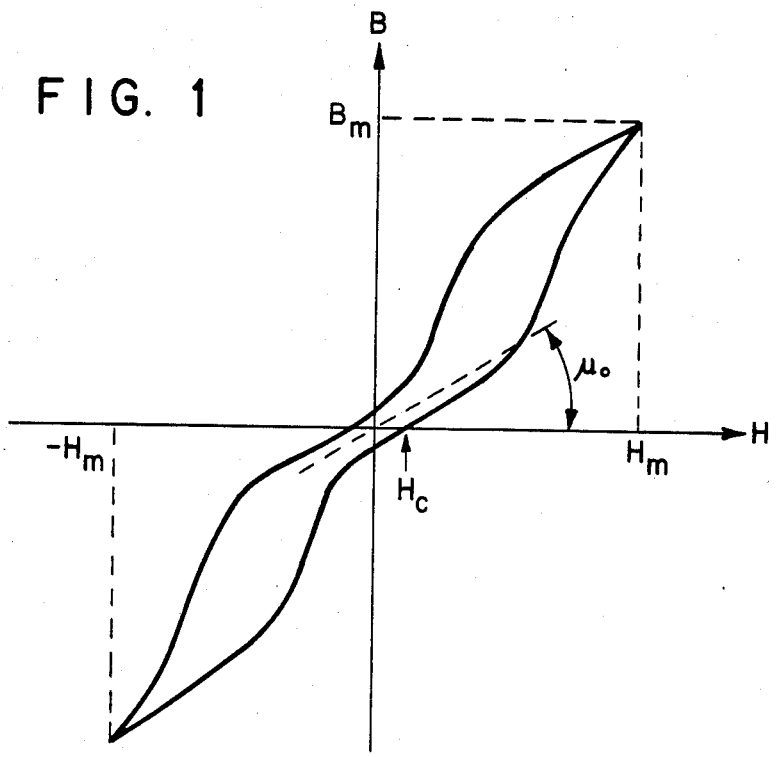
FIG. 1 is a graph depicting B-H behavior of a typical glassy Perminvar alloy when the exciting field $H_m$ is below the saturation field, $B_m$ being the corresponding flux density, $H_c$ being the coercivity and $u_o$ being the initial permeability near zero excitation field.

In accordance with the invention, there is provided a ferromagnetic marker capable of generating both even and odd higher harmonics of the frequency of the exciting field, which is made from a glassy metal with the Perminvar properties characterized by a nearly constant permeability at low magnetic field excitation and a constricted B-H loop. The B(induction)-H(magnetic field) behavior is illustrated in FIG. 1 and may be approximated by $$B=\mu_1 H+\mu_2 H^2+\mu_3 H^3$$

where $\mu_1$, $\mu_2$ and $\mu_3$ are constant. The quantity $\mu_3$ introduces an additional nonlinearity to the conventional B-H behavior characterized by FIG. 2.

When an ac field $H=H_m \exp(i\omega t)$ is applied to a glassy metal alloy with the Perminvar characteristics, the resultant flux B has a form $$B = B_1\cos(\omega t - \phi) + \sum_{n=1}^{\infty} B_{2n+1}\sin(2n+1)\omega t + \sum_{n=0}^{\infty} B_{2n+2}\sin(2n+2)\omega t,$$

where $$B_1 = (\mu_1 + \mu_3 H_m^3)Hm$$

$$B_{2n+1} = (8\mu_2 H_m^2/\pi\{1/(4n^2+1)(2n+3)\}$$

$$B_{2n+2} = (4\mu_3 H_m^3/\pi)\{4(n+1)/(4n^2-1)(2n+3)(2n+5)\} \text{ and}$$

$$\phi = \tan^{-1}\{8\mu_2 H_m/3\pi(\mu_1 + \mu_3 H_m^2)\}.$$

It is noted that Equation 2 contains even harmonic terms ($B_{2n+2}$) as well as odd harmonic terms ($B_{2n+}$).

The significance of the even harmonic terms can be readily demonstrated by calculating the ratio of the amplitude of an even and an odd harmonic term, which is given by $B_{2n+2}/B_{2n+1}=(\mu_3 H_m/\mu_2)\{(2n+2)/(2n+5)\}$. When $\mu_3$ is zero, Equations 1 and 2 describe the B-H behavior of a conventional ferromagnet of FIG. 2.

The glassy Perminvar alloy adopted in the present invention can be any alloy having the composition $Co_a Fe_b Ni_c M_d B_e Si_f$, where M is at least one member selected from the group consisting of Cr, Mo, Mn and Nb, quantities "a", "b", "c", "d", "e" and "f" being in atom percent and the sum (a+b+c+d+e+f) being equal to 100, and "a" ranges from about 66 to 71, "b" ranges from about 2.5 to 4.5, "c" ranges from about 0 to 3, "d" ranges from about 0 to 2 except when M=Mn in which case "d" ranges from about 0 to 4, "e" ranges from about 6 to 24, and "f" ranges from about 0 to 19. The purity of the above composition is that found in normal commercial practice. However, it would be appreciated that the metal M in the alloys of the invention may be replaced by at least one other element such as vanadium, tungsten, tantalum, titanium, zirconium and hafnium, and up to about 4 atom percent of Si may be replaced by carbon, aluminum or germanium without significantly degrading the desirable magnetic properties of these alloys. The glassy alloy has a value of magnetostriction ranging form about $-1\times10^{-6}$ to $+1\times10^{-6}$, a saturation induction ranging from about 0.5 to 1 Tesla, a Curie temperature ranging from about 200 to 450° C. and the first crystallization temperature ranging from about 400 to 570° C.

Figure 3:
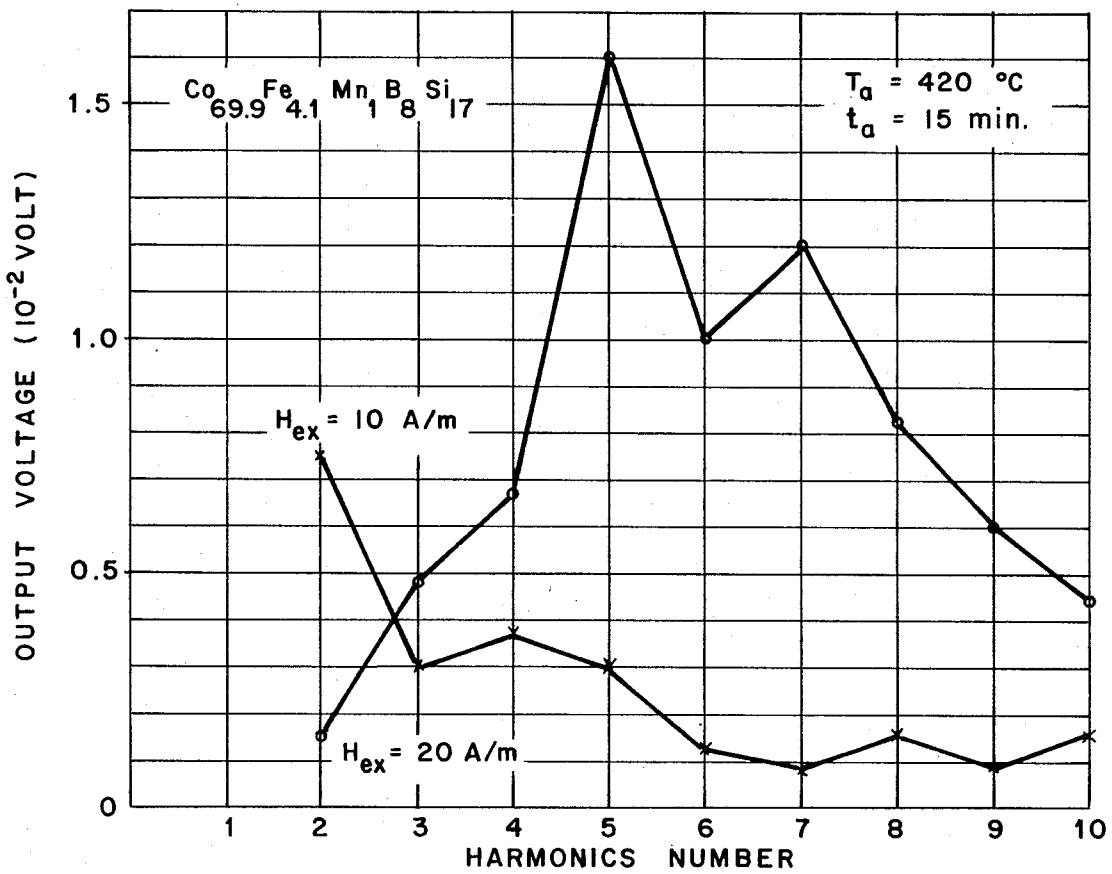
FIG. 3 shows at two different excitation levels the output signal voltage for up to the 10th harmonic for a toroidal sample exhibiting typical glassy Perminvar properties.
Figure 4:
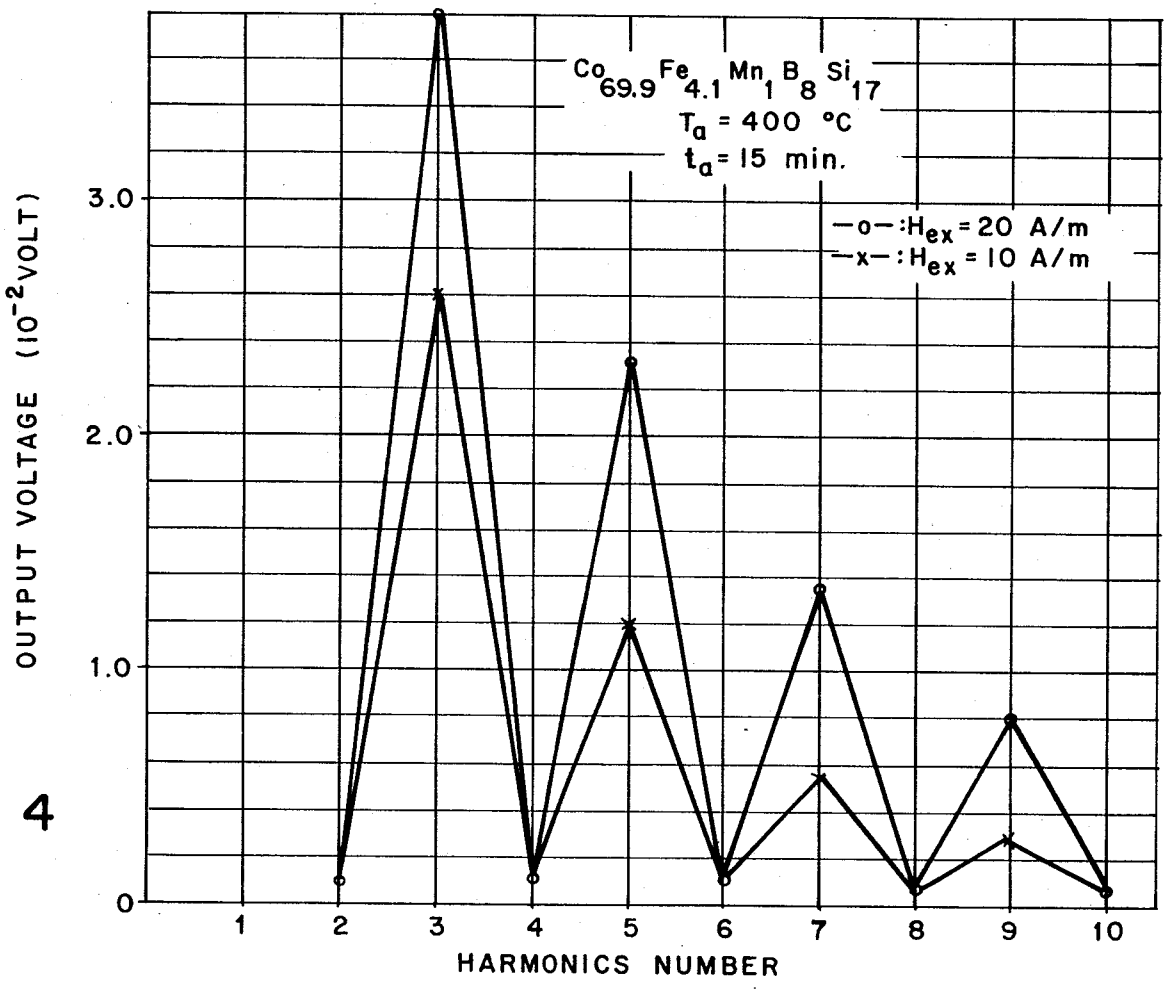
FIG. 4 shows at two excitation levels the output signal voltage for up to the 10th harmonic for a toroidal sample made from a near-zero magnetostrictive glassy alloy having conventional B-H behavior.

A magnetic circuit was devised in which a toroidal core made from a glassy Perminvar alloy was excited in the primary winding by an ac field with a frequency of 1 kHz and the secondary winding detected the higher harmonic signals. FIG. 3 illustrates the harmonic signal voltages for two different exciting field levels for a typical glassy Perminvar alloy. Similar results are summarized in FIG. 4 for a typical near-zero magnetostrictive glassy alloy without Perminvar properties. In contrast to FIG. 3, this figure shows depressed levels of the even harmonics and more importantly the excited field dependence of the harmonic signals is monotonic and predictable. While changes of the alloy chemistry and heat-treatment conditions do not appreciably affect the general harmonic behavior of conventional glassy ferromagnets with near-zero magnetostriction, similar changes drastically affect the harmonic behaviors of glassy Perminvar alloys. To illustrate this point, compare FIG. 3 with FIG. 5 which is taken for a different glassy Perminvar alloy than that for the former.

Figure 5:
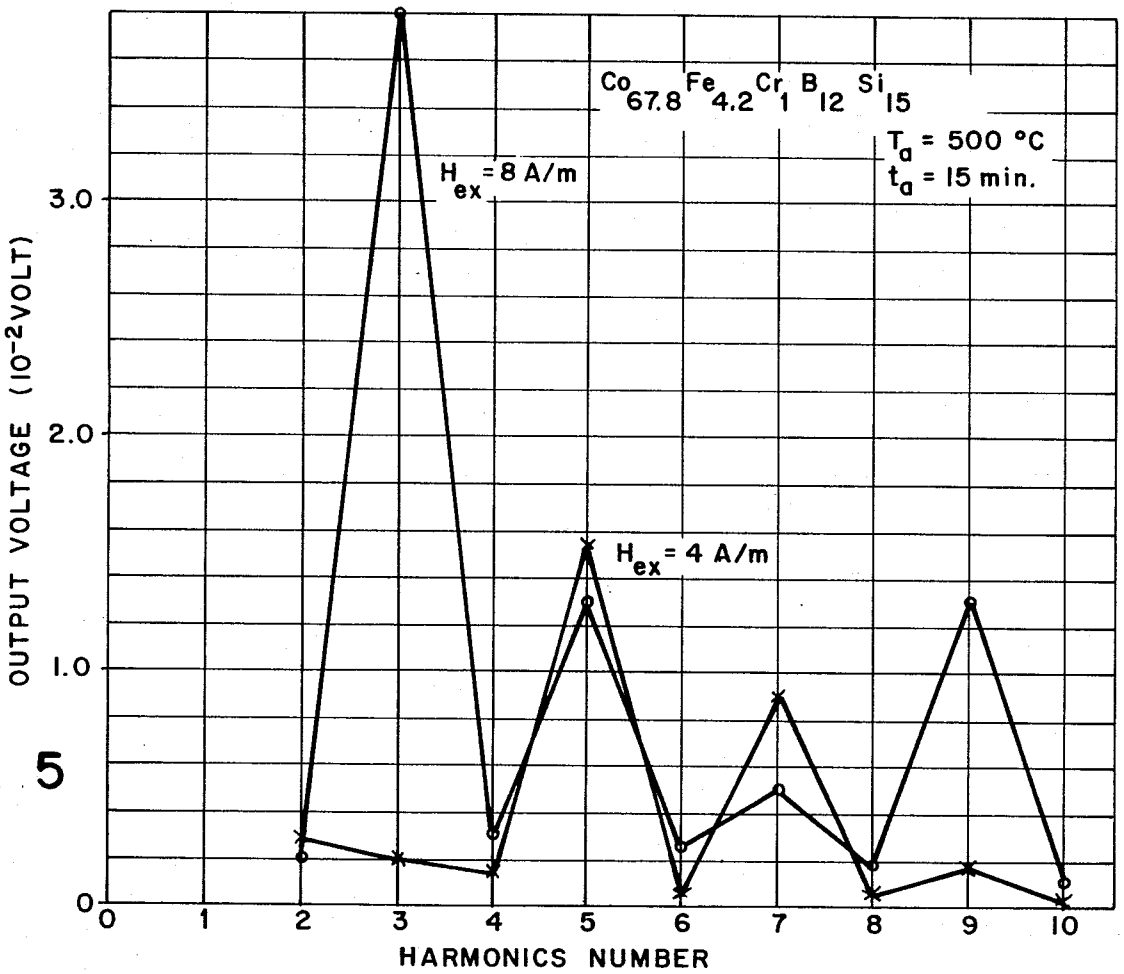
FIG. 5 shows at two excitation levels the output voltage for up to 10th harmonic for a toroidal sample made from a different near-zero magnetostrictive glassy alloy having Perminvar properties.
Figure 6:
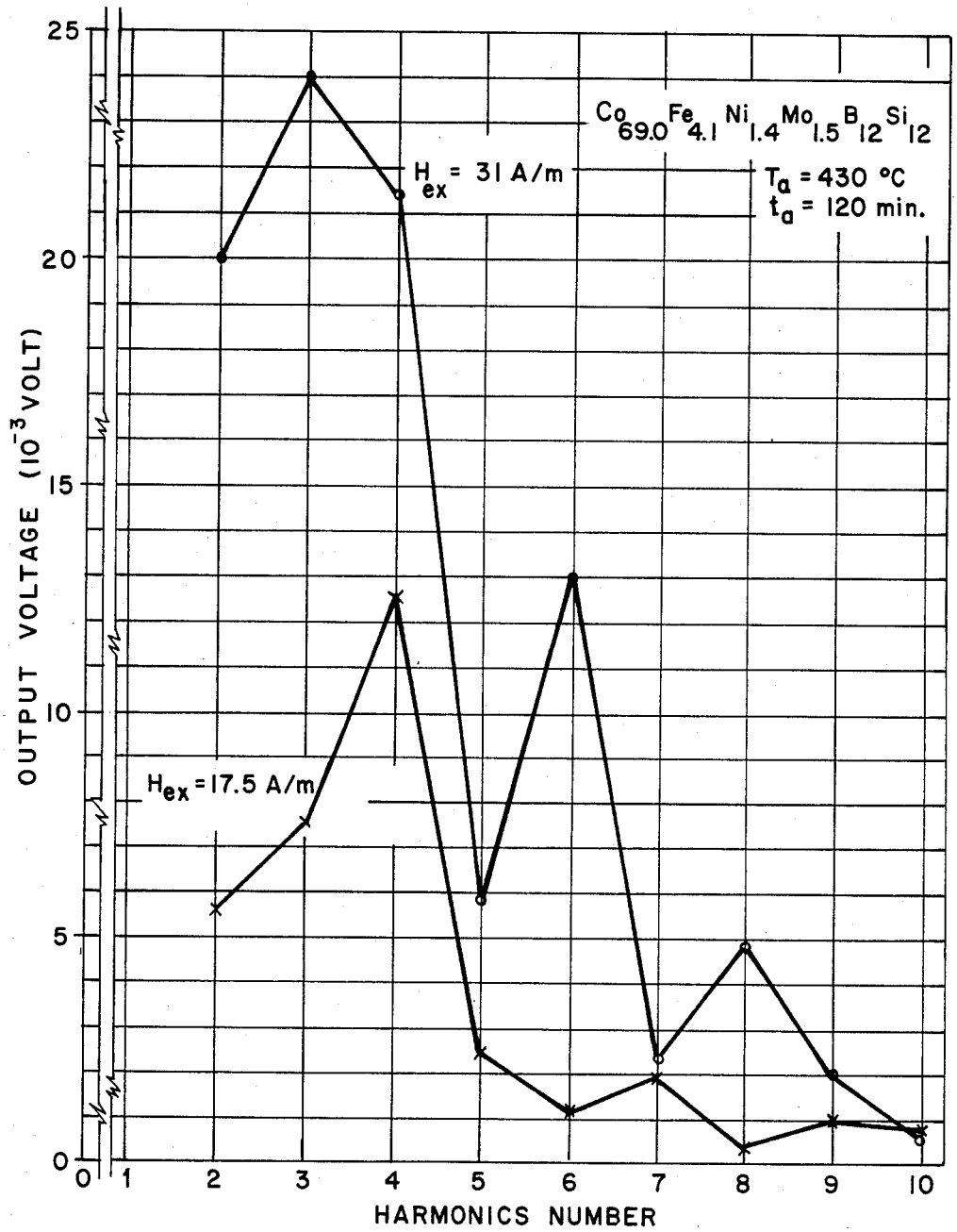
FIG. 6 shows at two excitation levels the output voltage for up to the 10th harmonic for a marker of the invention having typical glassy alloy Perminvar behavior.
Figure 7:
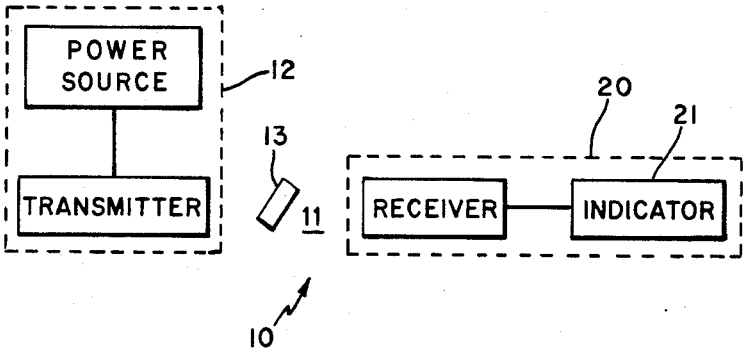
FIG. 7 is a block diagram of an identification system incorporating the present invention.

As an identification marker, an elongated strip or wire is more convenient than a toroid. Thus a magnetic circuit was devised in which an elongated strip of size $0.3\times10$ cm of a glassy Perminvar alloy was excited by applying an ac field with a frequency of 1 kHz and the higher frequency harmonic components of the resultant flux were detected by a coil surrounding the strip. The results are illustrated in FIG. 6, showing again different harmonic signals detected for different excitation levels as illustrated in FIGS. 3 and 5.

The glassy metal marker of the invention is thus coded by utilizing its unique high frequency harmonic characteristics. Decoding is then performed by analyzing the harmonic behavior of such marker. For example, a glassy metal marker of a given chemical composition which is properly heat-treated to obtain Perminvar properties exhibits a pattern of higher harmonic generation unique to this particular marker, which is used as its identifying code. The exciting field dependence of the harmonic signals of the marker of the invention further leads to a multiple stage coding/decoding system.

The simplest case is to identify two classes of objects; one carrying a marker made from a regular near-zero magnetostrictive glassy alloy and the other carrying a marker made from a near-zero magnetostrictive alloy with Perminvar properties. The former marker generates predominantly odd harmonics of the frequency of the exciting field and the latter generates both even and odd harmonics. These two different kinds of signals can be easily identified by a detector with pertinent tuned circuits.

A system to unequivocally identify the marker of the invention is provided as follows:

Referring to FIGS. 7, 8, 9 and 10 of the drawings, there is shown a magnetic identification system 10 responsive to the presence of an object carrying a magnetic marker within an interrogation zone 11. The system 10 has means for defining an interrogation zone 11. A field generating means 12 is provided for generating a magnetic field within the interrogation zone 11. A marker 13 is carried by a person 14 (see FIG. 8) or an object 15 (see FIGS. 9 and 10) appointed for passage through the interrogation zone 11. The marker is an elongated, ductile strip or wire of a glassy metal with or without Perminvar properties capable of producing magnetic fields at frequencies which are higher harmonics of the frequency of the exciting field provided by the field generating means 12. The generated harmonic signals have a feature unique to the marker, providing an identifiable code assigned to the marker. An identification means 20 is arranged to unequivocally identify the pattern of the harmonic signals produced in the vicinity of the interrogation zone 11 by the presence of marker 13 therewithin.

Typically, the system 10 includes a pair of coil units 16 and 17 desposed on opposing sides of a path leading to the exit 18 (see FIGS. 8 and 9) of the system. Detection circuitry, including an identification means 20 and an indicator 21, is housed within a cabinet 30 located near the exit 18. When the marker 13 attached to a person 14 (see FIG. 8) or an object 15 (see FIG. 9) passes through the interrogation zone 11, the identification means 20 decodes the identifying signal which, in turn, is displayed on the indicator 21. Thus the person 14 (see FIG. 8) or the object 15 (see FIG. 9) can be identified. The identified person 14 or object 15 can then be guided to a predetermined position beyond the exit 18.

Figure 8:
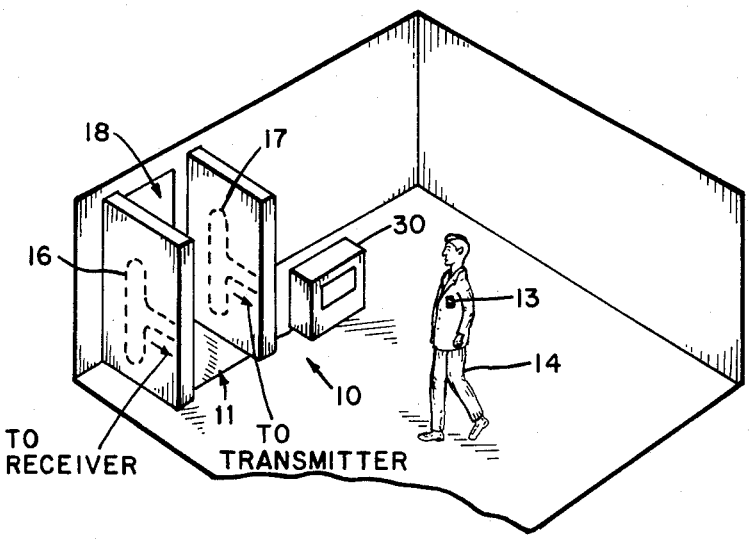
FIG. 8 is a diagrammatic illustration of a personal security system incorporating the alloy of FIG. 1.
Figure 9:
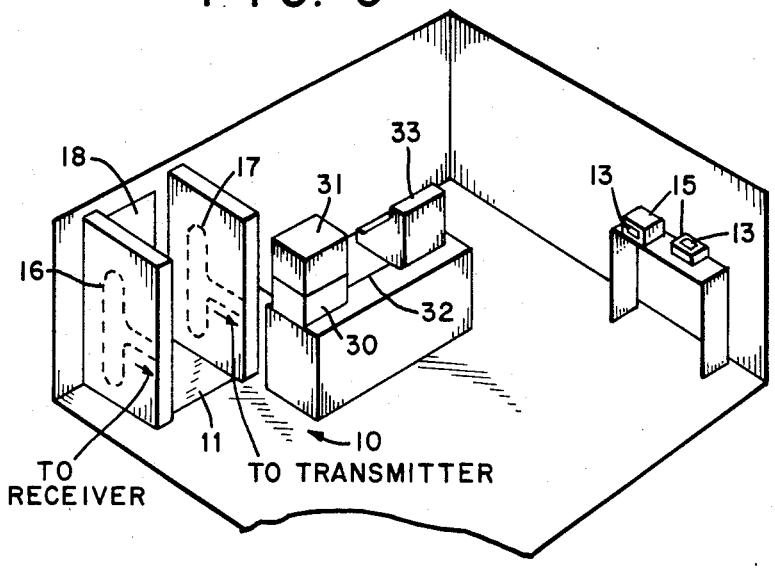
FIG. 9 is a diagrammatic illustration of a store installation based on the system of FIG. 1 which functions as a theft detection system and wherein the articles sold are identified and recorded in a computer for inventory follow-up.

The system of the present invention can thus be used as a personal security system as in FIG. 8, or as an inventory monitoring/theft detection system as in FIG. 9. In the latter case, the identification means 20 in the cabinet 30 is connected electronically through cable 32 to computer 31 and cash register 33. Theft detection is accomplished by comparing the information from the cash register 33 and that from the identification means 20 by using computer 31. The same information is also used for inventory monitoring.

Figure 10:
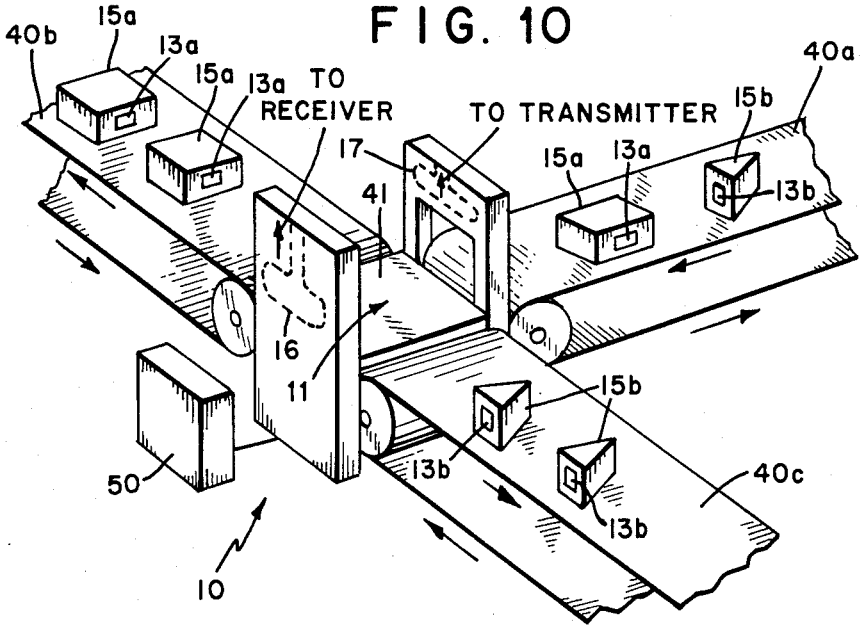
FIG. 10 is a diagrammatic illustration of a sorting system in a automatic production line based on the system of FIG. 1.

The identification system 10 can be used in sorting systems in automatic production lines as in FIG. 10. In this figure, two different kinds of products 15*a* and 15*b* carrying two different kinds of markers 13*a* and 13*b* respectively of the invention are brought by a conveyer belt 40a into the interrogation zone 11 in which the identification system of FIG. 1, situated in the cabinet 50, identifies the products. The signal from the indicator 21 in the cabinet 50 is fed to a controller in the same cabinet which, in turn, activates the sorting mechanism 41 such that all of the products 15*a* and 15*b* are transfered to conveyer belts 40*b* and 40*c* respectively.

The detection system circuitry with which the marker 13 is associated can be any system capable of (1) generating within the interrogation zone an incident magnetic field, and (2) detecting magnetic field variations at selected harmonic frequencies produced in the vicinity of the interrogation zone by the presence of the marker therewithin. Such systems typically include means for transmitting a varying electrical current from an oscillator and amplifier through conductive coils that form a frame antenna capable of developing a varying magnetic field. An example of such antenna arrangement is disclosed in French Pat. No. 763,681, published May 4, 1934, which description is incorporated herein by reference thereto.

The glassy alloy is prepared by cooling a melt of the desired composition at a rate of at least about $10^5$K/sec, employing metal alloy quenching techniques well-known to the glassy metal alloy art; see, e.g. U.S. Pat. No. 3,856,513 to Chen et al. The purity of all constituents is that found in normal commercial practice.

A variety of techniques are available for fabricating continuous ribbon, wire, sheet, etc. Typically, a particular composition is selected, powders or granules of the requisite elements in the desired portions are melted and homogenized, and the molten alloy is rapidly quenched on a chill surface, such as a rapidly rotating metal cylinder.

Under these quenching conditions, a metastable, homogeneous, ductile material is obtained. The metastable material may be glassy, in which case there is no long range order. X-ray diffraction patterns of glassy metal alloys show only a diffuse halo, similar to that observed for inorganic oxide glasses. Such glassy alloys must be at least 70% glassy to be useful in the present invention.

The glassy alloy having Perminvar characteristics for use in the present invention is heat-treated at a temperature between about 50 and 110° C. below the first crystallization temperature of the material for a time period between about 15 and 180 minutes and then cooled to room temperature at rate slower than about −60° C./min. Some of the examples of the heat-treatment conditions and resultant magnetic properties for some of the glassy Perminvar alloys are listed in Table I. Here the quantities $\mu_o$ and $H_c$ are as defined in FIG. 1. The glassy alloys listed in this table have magnetostrictions ranging from about $-1\times10^{-6}$, to about $+1\times10^{-6}$, saturation inductions ranging from about 0.5 to 1 Tesla, Curie temperatures ranging from about 200 to 45° C. and the first crystallization tempertures ranging from about 440 to 570° C.

TABLE I

Heat-treatment temperature ($T_a$) and duration ($t_a$) to obtain Perminver characteristics in the glassy alloys of the present invention. Cooling rate is about −5° C./min. unless stated otherwise. The quantity $\mu_o$ is the initial dc permeability and $H_c$ is the dc coercivity obtained after the heat-treatment.

| Compositions | | | | | | | | |
|---|---|---|---|---|---|---|---|---|
| Co | Fe | Ni | M | B | Si | $T_a$ (°C.) | $t_a$ (min) | $H_c$ (A/m) | $\mu_o$ |
| 70.5 | 4.5 | — | — | 15 | 10 | 460 | 15 | 3.4 | 7900 |
| 70.5 | 4.5 | — | — | 15 | 10 | 460 | 15[b] | 3.1 | 5700 |
| 70.5 | 4.5 | — | — | 15 | 10 | 460 | 15[c] | 1.4 | 7600 |
| 69.0 | 4.1 | 1.4 | Mo = 1.5 | 12 | 12 | 430 | 120 | 1.2 | 4000 |
| 69.0 | 4.1 | 1.4 | Mo = 1.5 | 12 | 12 | 430 | 150 | 3.6 | 4000 |
| 69.0 | 4.1 | 1.4 | Mo = 1.5 | 12 | 12 | 420 | 180 | 6.4 | 12250 |
| 65.7 | 4.4 | 2.9 | Mo = 2 | 11 | 14 | 420 | 15 | 4.0 | 33000 |
| 68.2 | 3.8 | — | Mn = 1 | 12 | 15 | 480 | 15 | 0.20 | 19000 |
| 68.2 | 3.8 | — | Mn = 1 | 12 | 15 | 500 | 15 | 7.6 | 13000 |
| 67.7 | 3.3 | — | Mn = 2 | 12 | 15 | 480 | 15 | 0.20 | 22000 |
| 67.7 | 3.3 | — | Mn = 2 | 12 | 15 | 500 | 15 | 0.20 | 22000 |
| 67.8 | 4.2 | — | Mo = 1 | 12 | 15 | 500 | 15 | 0.44 | 90000 |
| 67.8 | 4.2 | — | Cr = 1 | 12 | 15 | 480 | 15 | 0.20 | 50000 |
| 67.8 | 4.2 | — | Cr = 1 | 12 | 15 | 500 | 15 | 0.44 | 30000 |
| 69.2 | 3.8 | — | Mo = 2 | 8 | 17 | 460 | 15 | 4.2 | 9700 |
| 69.2 | 3.8 | — | Mo = 2 | 8 | 17 | 460 | 30 | 4.9 | 10000 |
| 69.2 | 3.8 | — | Mo = 2 | 8 | 17 | 460 | 45 | 4.5 | 8000 |
| 69.2 | 3.8 | — | Mo = 2 | 8 | 17 | 460 | 90 | 5.0 | 7500 |
| 69.2 | 3.8 | — | Mo = 2 | 8 | 17 | 460 | 105 | 3.9 | 7900 |
| 69.2 | 3.8 | — | Mo = 2 | 8 | 17 | 380 | 45 | 4.7 | 12700 |
| 67.5 | 4.5 | 3.0 | — | 8 | 17 | 380 | 60 | 4.5 | 9600 |
| 67.5 | 4.5 | 3.0 | — | 8 | 17 | 380 | 90 | 3.6 | 11500 |
| 67.5 | 4.5 | 3.0 | — | 8 | 17 | 380 | 105 | 5.0 | 15800 |
| 67.5 | 4.5 | 3.0 | — | 8 | 17 | 420 | 15 | 3.6 | 7200 |
| 70.9 | 4.1 | — | — | 8 | 17 | 400 | 15 | 7.0 | 5000 |
| 70.9 | 4.1 | — | — | 8 | 17 | 420 | 15 | 2.0 | 2400 |
| 69.9 | 4.1 | — | Mn = 1 | 8 | 17 | 400 | 15 | 1.7 | 2500 |
| 69.9 | 4.1 | — | Mn = 1 | 8 | 17 | | | | |
| 69.0 | 4.0 | — | Mn = 2 | 8 | 17 | | | | |
| 69.0 | 4.0 | — | Mn = 2 | 8 | 17 | | | | |
| 68.0 | 4.0 | — | Mn = 3 | 8 | 17 | | | | |
| 68.0 | 4.0 | — | Mn = 3 | 8 | 17 | | | | |
| 67.1 | 3.9 | — | Mn = 4 | 8 | 17 | | | | |
| 69.0 | 4.0 | — | Cr = 2 | 8 | 17 | | | | |
| 69.0 | 4.0 | — | Cr = 2 | 8 | 17 | | | | |
| 68.0 | 4.0 | — | Mn = 2,Cr = 1 | 8 | 17 | | | | |
| 68.0 | 4.0 | — | Mn = 2,Cr = 1 | 8 | 17 | | | | |
| 69.0 | 4.0 | — | Nb = 2 | 8 | 17 | | | | |
| 68.1 | 4.0 | 1.4 | Mo = 1.5 | 8 | 17 | | | | |
| 68.1 | 4.0 | 1.4 | Mo = 1.5 | 8 | 17 | | | | |
| 65.7 | 4.4 | 2.9 | Mo = 2 | 23 | C = 3[a] | | | | |
| 65.7 | 4.4 | 2.9 | Mo = 2 | 23 | 2 | | | | |
| 69.5 | 4.1 | 1.4 | — | 6 | 19 | | | | |
| 68.5 | 4.4 | — | Mo = 2 | 21 | Ge = 4[a] | | | | |
| 70.5 | 4.5 | — | — | 24 | Ge = 1[a] | | | | |
| 69.2 | 3.8 | — | Mo = 2 | 10 | 15 | | | | |
| 69.2 | 3.8 | — | Mo = 2 | 10 | 15 | | | | |
| 69.0 | 3.0 | — | Mn = 3 | 10 | 15 | | | | |
| 68.5 | 2.5 | — | Mn = 4 | 10 | 15 | | | | |
| 68.8 | 4.2 | — | Cr = 2 | 10 | 15 | | | | |

TABLE I-continued

Heat-treatment temperature ($T_a$) and duration ($t_a$) to obtain Perminver characteristics in the glassy alloys of the present invention. Cooling rate is about −5° C./min. unless stated otherwise. The quantity $\mu_o$ is the initial dc permeability and $H_c$ is the dc coercivity obtained after the heat-treatment.

| | | | |
|---|---|---|---|
| 420 | 15 | 0.84 | 3600 |
| 400 | 15 | 3.2 | 13000 |
| 420 | 15 | 0.98 | 5000 |
| 400 | 15 | 2.0 | 29000 |
| 420 | 15 | 3.3 | 21500 |
| 420 | 15 | 0.70 | 15800 |
| 420 | 15 | 0.80 | 24000 |
| 440 | 15 | 0.84 | 21500 |
| 420 | 15 | 1.4 | 31500 |
| 440 | 15 | 1.1 | 24000 |
| 440 | 15 | 3.4 | 28700 |
| 440 | 15 | 2.9 | 35800 |
| 460 | 15 | 3.6 | 19300 |
| 440 | 15 | 5.6 | 2300 |
| 450 | 15 | 10.4 | 8000 |
| 380 | 15 | 12 | 3300 |
| 480 | 15 | 5.2 | 17000 |
| 420 | 15 | 6 | 600 |
| 450 | 60 | 1.5 | 21000 |
| 460 | 60 | 1.6 | 19300 |
| 440 | 15 | 1.2 | 17500 |
| 440 | 15 | 1.2 | 23000 |
| 460 | 15 | 0.8 | 20000 |

[a]All of Si content is replaced by the element indicated
[b]Cooling rate ≃ −60° C./min.
[c]Cooling rate ≃ −3° C./min.

Figure 2:
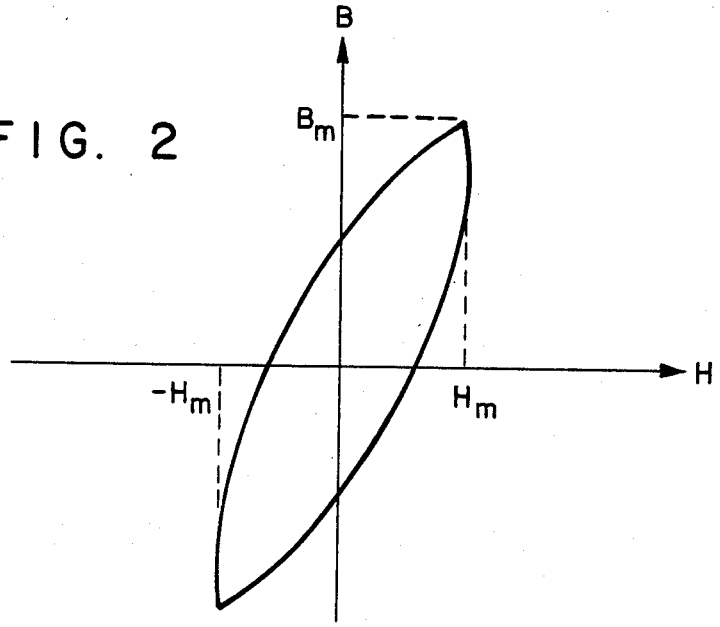
FIG. 2 is a graph depicting B-H behavior for a conventional soft ferromagnet when the exciting field $H_m$ is lower than the saturation field.

The same alloy listed in Table I is heat-treated at temperatures lower than 110° C. below the first crystallization temperature of the material, resulting in a conventional soft ferromagnet having a B-H behavior similar to that of FIG. 2. This material can be used in the present invention as a marker exhibiting predominantly odd harmonics similar to those illustrated in FIG. 4.

EXAMPLES

1. Sample Preparation

The glassy alloys listed in Table I and FIGS. 3–6 were rapidly quenched (about $10^6$K/sec) from the melt following the techniques taught by Chen and Polk in U.S. Pat. No. 3,856,513. The resulting ribbons, typically 25 to 30 μm thick and 0.5 to 2.5 cm wide, were determined to be free of significant crystallinity by X-ray diffractometry (using CuK radiation) and scanning calorimetry. Ribbons of the glassy metal alloys were strong, shiny, hard and ductile.

2. Magnetic measurements

Continuous ribbons of the glassy metal alloys prepared in accordance with the procedures described in Example 1 were wound onto bobbins (3.8 cm O.D.) to form closed-magnetic-path toroidal samples. Each sample contained from 1 to 3 g of ribbon. Insulated primary and secondary windings (numbering at least 10 each) were applied to the toroids. These samples were used to obtain hysteresis loops and initial permeability with a commercial curve tracer core loss (IEEE Standard 106–1972), and to obtain harmonic signals by using a commercial frequency analyzer.

The ribbon shape alloys were cut into 0.3×10 cm strips for use as the markers of the present invention and were heat-treated to obtain desired B-H behaviors. These strips were placed in a quartz tube onto which insulated primary (numbering 10) and secondary windings (numbering 450) were applied. An exciting current at the frequency of 1 kHz was applied to the primary winding and the voltage appearing at the secondary winding (designated as output voltage) was processed by a commercial frequency analyzer to obtain harmonic signals. The primary and secondary windings correspond to the pair of coils 17 and 16 respectively in FIG. 8 and the strip to the marker 13 in FIGS. 7 and 8.

The saturation magnetization, $M_s$, of each sample, was measured with a commercial vibrating sample magnetometer (Princeton Applied Research). In this case, the ribbon was cut into several small squares (aproximately 2 mm ×2 mm). These were randomly oriented about their normal direction, their plane being parallel to the applied field (0 to 720 kA/m). The saturation induction $B_s$ ($=4\pi M_s D$) was then calculated by using the measured mass density D.

The ferromagnetic Curie temperature ($\theta_f$) was measured by inductance method and also monitored by differential scanning calorimetry, which was used primarily to determine the crystallization temperatures. The first or primary crystallization temperature ($T_{c1}$) was used to compare the thermal stability of various glassy alloys of the present and prior art inventions.

Magnetostriction measurements employed metallic strain gauges (BLH Electronics), which were bonded (Eastman - 910 Cement) between two short lengths of ribbon. The ribbon axis and gauge axis were parallel. The magnetostriction was determined as a function of applied field from the longitudinal strain in the parallel $(\Delta l/l)_{\parallel}$ and perpendicular $(\Delta l/l)_{\perp}$ in-plane fields, according to the formula $\lambda=\frac{2}{3}[(\Delta l/l)_{\parallel}-(\Delta l/l)_{\perp}]$.

Having thus described the invention in rather full detail, it will be understood that this detail need not be strictly adhered to but that further changes and modifications may suggest themselves to one skilled in the art, all falling within the scope of the invention as defined by the subjoined claims.

What is claimed is:

1. For use in a magnetic identification system, a marker comprising ductile amorphous ferromagnetic material adapted to generate magnetic fields at frequencies that are odd and even harmonics of an incident magnetic field applied to the marker within an interrogation zone, said odd and even harmonics being independently detectable and discriminable to provide said marker with signal identify and coding capability, said material exhibiting a Perminvar-type B-H loop pattern.

2. The marker as recited in claim 1 wherein the material has a coercivity not greater than about 10.4 A/m and an initial permeability which is substantially constant in the range of near zero magnetic excitation levels.

3. The marker of claim 1 wherein said material is an elongated strip.

4. The marker of claim 1 wherein the material is a wire.

5. For use in an identification system, a marker comprising ductile amorphous ferromagnetic material adapted to generate magnetic fields at frequencies that are odd and even harmonics of an incident magnetic field applied to the marker within an interrogation zone, said odd and even harmonics being independently detectable to provide said marker with signal identity and coding capability, said material having a composition defined by the formula $Co_aFe_bNi_c M_dB_eSi_f$, wherein M is at least one element selected from the groups of Cr,Mo,Mn,Nb,V,W,Ta,Ti,Zr and Hf, wherein "a" is in the range of about 66 to about 71 atom percent, "b" is in the range of about 2.5 and about 4.5 atom percent, "c" is in the range of 0 to about 3 atom percent, "d" is in the range of 0 to about 2 atom percent except when M is Mn in which case "d" is in the range of about 0 to about 4 atom percent, "e" is in the range of about 6 to about 24 atom percent, and "f" ranges from about 0 to about 19 atoms percent, with up to about 4 atom percent of Si, if present, being replaceable by C, Al or Ge, the material having a value of magnetostriction ranging from about $-1\times10^{-6}$ to about $+1\times10^{-6}$, a saturation induction ranging from about 0.5 to about 1 Tesla, A Curie temperature ranging from about 200° C. to about 450° C. and a first crystallization temperature ranging from about 400° C. to about 570° C., and wherein said material has been heat-treated at a temperature between about 50° C. and about 110° C. below the first crystallization temperature of the material for a time period of between about 15 and about 180 minutes and then cooled at a rate slower than about −60° C./min.

6. The marker of claim 5 wherein said material is an elongated strip.

7. The marker of claim 5 wherein the material is a wire.

8. An identification system for identifying a body within an interrogation zone, the system comprising:

a. means for defining an interrogation zone;

b. means for generating a magnetic field within said interrogation zone;

c. a marker adapted to be secured to a body appointed for passage through said interrogation zone, said marker comprising ductile amorphous ferromagnetic metal capable of producing magnetic fields at frequencies which are both even and odd harmonics of the frequency of an incident field, said odd and even harmonics being independently detectable and discriminable to provide said marker with signal identity and coding capability, said material exhibiting a Perminvar-type B-H loop pattern;

d. detecting means for detecting odd and even harmonics produced in the vicinity of the interrogation zone by the presence of the marker therewithin, and e. means for identifying the body from the odd and even harmonics produced by the marker.

9. In a magnetic theft detection system, a marker for generating magnetic fields at frequencies that are harmonically related to an incident magnetic field applied within an interrogation zone and have selected tones that provide said marker with signal identity, the improvement wherein:

a. said marker generates both even and odd harmonics of the frequency of the incident magnetic field, said even and odd harmonics being independently detectable and discriminable, and operating in the aggregate to provide the detection system with at least one identity code, said marker comprising ductile amorphous ferromagnetic material exhibiting a Peminvar-type B-H loop pattern;

b. means for comparing said at least one identity code with preprogrammed codes to monitor the passage of said marker through said interrogation zone.

10. A sorting system in a automated production line responsive to the presence of an article within an interrogation zone, comprising:

a. means for defining an interrogation zone;

b. means for generating a magnetic field within said interrogation zone;

c. a marker secured to an article appointed for passage through said interrogation zone, said marker comprising ductile amorphous ferromagnetic metal capable of producing magnetic fields at frequencies which are both even and odd harmonics of the frequency of an incident field, said odd and even harmonics being independently detectable and discriminable to provide said marker with signal identity and coding capability, said material exhibiting a Perminvar-type B-H loop pattern;

d. detecting means for detecting odd and even harmonics of the incident magnetic field produced in the vicinity of the interrogation zone by the presence of the marker therewithin to establish a pattern of said harmonics for said article, thus providing said article with signal identity; and e. means for distributing said article to a preselected location in response to identifying the harmonic pattern of the marker associated with the article.

* * * * *

UNITED STATES PATENT AND TRADEMARK OFFICE

CERTIFICATE OF CORRECTION

PATENT NO. : 4,823,113

DATED : April 18, 1989

INVENTOR(S) : Hasegawa

It is certified that error appears in the above-identified patent and that said Letters Patent is hereby corrected as shown below:

Column 9, line 8 "atoms" should read --atom--.

Column 9, line 12, "Tesla, A" should read --Tesla, a--.

Signed and Sealed this

Twenty-eighth Day of November 1989

*Attest:*

JEFFREY M. SAMUELS

*Attesting Officer* *Acting Commissioner of Patents and Trademarks*